United States Patent [19]

Loder

[11] Patent Number: 4,586,630

[45] Date of Patent: May 6, 1986

[54] DISPENSING PACKAGE FOR SHEETS

[75] Inventor: Harry A. Loder, Mahtomedi, Minn.

[73] Assignee: Minnesota Mining and Manufacturing Company, St. Paul, Minn.

[21] Appl. No.: 595,236

[22] Filed: Apr. 2, 1984

[51] Int. Cl.[4] ..... B65H 1/04

[52] U.S. Cl. ..... 221/46; 221/63

[58] Field of Search ..... 221/33, 44–63, 221/305, 26; 225/106; 312/50, 60, 61

[56] References Cited

U.S. PATENT DOCUMENTS

| | | | |
|---|---|---|---|
| 2,279,658 | 4/1942 | Creebs | 221/45 |
| 2,849,152 | 8/1958 | Tuttle | 221/48 |
| 2,890,791 | 6/1959 | Wenzel | 221/48 X |
| 3,986,479 | 10/1976 | Bonk | 225/106 X |
| 4,191,306 | 3/1980 | Rabner | 221/33 |
| 4,416,392 | 11/1983 | Smith | 221/45 |

FOREIGN PATENT DOCUMENTS

| | | | |
|---|---|---|---|
| 793745 | 4/1958 | United Kingdom | 221/63 |

*Primary Examiner*—F. J. Bartuska

*Attorney, Agent, or Firm*—Donald M. Sell; James A. Smith; John C. Barnes

[57] ABSTRACT

A convenient dispensing package for a stack of adhesive-coated notepaper comprises a box for containing a stack of sheets with one end of the box formed with two flaps cut along parallel coincident edges and along a common third edge to define two mating indulated edges defining the dispensing opening.

9 Claims, 3 Drawing Figures

DISPENSING PACKAGE FOR SHEETS

BACKGROUND OF THE INVENTION

1. Field of the Invention

This invention relates to an improved package for sheets of notepaper or the like and for dispensing individual sheets from a stack in the package. In one aspect, the present invention relates to an improvement in packages for individually dispensing sheet material adhered together along one edge by a peelable layer wherein removal of one article withdraws one end of the next article which can then be separated without withdrawing the said second article.

2. Description of the Prior Art

The present invention provides an improvement in a dispenser for dispensing serially sheets of material which are provided in a stack wherein each sheet is releasably adhered to the next adjacent sheet along an end with each sheet adhered to the next adjacent sheet along opposite edges.

U.S. Pat. No. 4,416,392 (Smith), issued Nov. 22, 1983, and is assigned to the assignee of this application, discloses a dispenser for dispensing sheets of material wherein each sheet is adhered to the next adjacent sheet by a narrow band of adhesive material with the adhesive coated on the lower side of each sheet on alternately opposite edges of successive sheets. In the embodiments of the dispenser shown in the patent the sheets were dispensed from the stack through a fixed opening in the dispenser, and in one embodiment the short stack of sheets could be dispensed through the opening without the next successive sheet falling back through the opening during the dispensing operation or being withdrawn in a chain. A second embodiment was an improvement in that the stack of sheets is moved upwardly as they were dispensed toward the opening by a movable platform which was spring-urged toward the opening. This construction permits the stack of sheets to be greater, but, requires numerous parts. Other constructions exist for dispensing fan-folded sheets or stamps, and one known stamp dispenser is illustrated in U.S. Pat. No. 4,191,306. issued May 4, 1980 to W. P. Rabner. In this dispenser the fan-folded sheets are adhered together and withdrawing one will withdraw the other, but then the sheets must be severed by tearing along the perforate edge defining the line of separation. Again, this dispenser had a fixed opening and was adapted to handle a small number of articles such that the article being dispensed did not have a length which would exceed the height of the dispenser such that the articles did not have a tendency to fall back into the dispenser. Separation of the stamps was not accomplished with continued withdrawing or pulling force being applied to the stamp.

The present invention readily overcomes the disadvantages known in prior known dispensers for individual sheets or strips of material.

The present invention affords a means for dispensing individual sheets in a manner which makes the successive dispensing of the next sheet substantially effortless.

SUMMARY OF THE INVENTION

The present invention provides an improved package for a stack of sheet material such as utilized for notes, routing slips, labels, color coding, place marks, messages, or reminders. The sheets are releasably adhered along alternately opposite edges of successive sheets such that the sheets are adhered together in a stack but are readily peeled apart when a peeling force is placed on the sheets adjacent said edges. The dispenser comprises a box-like package having at one end a pair of slits running generally parallel to each other and parallel to the edges of the box with a centrally disposed transverse undulated slit connecting each of the parallel slits substantially centrally thereof. The box-like package is formed of box board and contains a stack of the sheet material. As the sheet material is dispensed from the box each successive sheet exits the box through the slit between the mating undulating edges, and the next successive sheet is gripped between the edges which, because of the interfering pattern defined by the edges at the opening, the sheet is clamped between the edges to prevent the sheet from falling back into the box.

The box-dispenser may be supported in a channel-shaped frame member which is adapted to be mounted on a wall, sun visor, telephone stand, a cabinet, under a cabinet or shelf, etc., permitting the sheets to be dispensed from the package-dispenser in any position. The fastening means may be a strip of double-coated tape, magnetic material, a spring clip, or a hook and loop fastener tape or other fastening material which will support the frame on a suitable accommodating surface.

BRIEF DESCRIPTION OF THE DRAWINGS

The present invention will be further described with reference to the accompanying drawing wherein.

DESCRIPTION OF THE PREFERRED EMBODIMENTS

The present invention is directed to an improved package dispenser for sheets of material which are joined together along one edge thereof such that the sheets are joined along alternately opposite edges of successive sheets in such a manner that they may be separated by a peeling force applied against the edge of the successive sheets. The sheets may be preferably adhered together by a narrow band of pressure-sensitive adhesive or by another substance which has greater shear strength than peel strength such that pulling on one sheet to draw the same through the opening of the dispenser will cause the next adjacent sheet to buckle, and the adjacent free end to be drawn from the stack through the exit opening with the dispensed sheet before the peel force is placed against the edges of the sheets.

Figure 1:
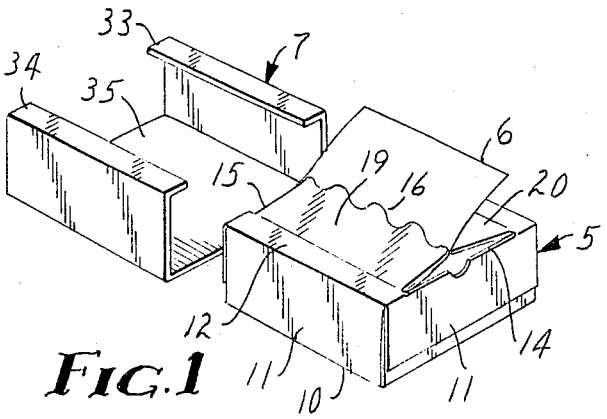
FIG. 1 is an exploded perspective view of the package-dispenser of the present invention and a mounting bracket for mounting the package on different surfaces.

Referring now to FIG. 1 there is illustrated a package dispenser 5 constructed according to the present invention, with a sheet of material 6 extending from the outlet opening thereof, and a mounting sleeve or holder 7 for receiving the package-dispenser 5 and supporting it in a fixed position on any one of a number of desired surfaces to locate the package dispenser handily.

The package-dispenser 5 is formed in the general shape of a box to contain the stack of sheets and has a pair of flaps which define the dispensing opening. The package 5, as illustrated in the drawings, comprises a base 10 joined by four perpendicular side walls 11 and a top wall 12 for enclosing the stack of sheet material 6. The top wall 12 is formed with a pair of slits or cut portions 14 and 15 which are joined by a second slit of wave shape 16 to define an opening in the wall 12 through which the sheets may be dispensed. The length of the cut portions or slits 14 and 15 depend on the rigidity of the material forming the package dispenser 5, to give the flap members 19 and 20 the desired resilience or spring action which is inherent in the rigidity or elasticity of the material.

Figure 2:
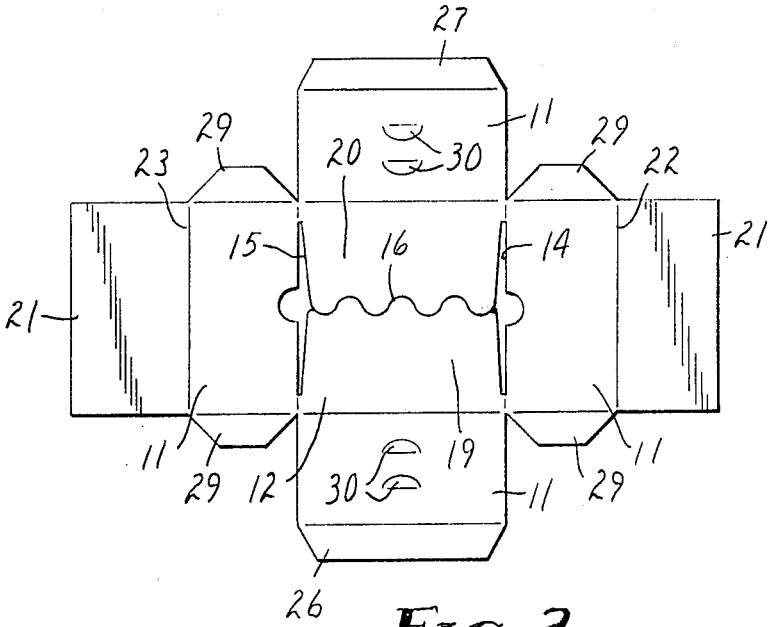
FIG. 2 is an elevational view of the box blank for forming the package-dispenser.

A preferred material for forming the package dispenser is a twenty four point box board stock which may be cut into a blank, as illustrated in FIG. 2. As shown in FIG. 2, the blank comprises a rectangular center portion which defines the wall 12 and which is formed with cut-out portions 14 and 15 and the wave-shaped slot 16. Radiating from the center portion defining the wall 12 and joined thereto by fold lines are four flaps which define the side walls 11 of the dispenser. Two of the side walls 11, on the right and the left of the center portion as viewed in FIG. 2, are formed with rectangular flaps 21 joined by fold lines 22 and 23. The flaps 21 form the base 10 of the dispenser. The flaps 21 are sealed to the side walls 11 by two flaps 26 and 27 supported on the two adjacent side walls 11. Additional flaps 29, which are formed on each of the side walls 11 which are joined to the flaps 21, support the side walls 11 in fixed relation to each other. The flaps 19 and 20 defining the adjustable exit opening are designed such that the flap 19 can press a sheet of paper against the projecting end portions of the flap 20 to capture the sheet between the extended ends of the flap 19 and the extended ends of the flap 20. The resilience and gripping force is obtained from the length of the slits 14 and 15 and rigidity of the material. The shorter the flaps the more rigid they may be when formed of the same material.

If required for packages of more than three hundred sheets of material, the side walls 11 should be formed with some means for supporting the sheets as they are raised off the stack. An example is the use of louvers as shown at 30 in FIG. 2 which louvers serve as shelves to support the edges of sheets as they are drawn up the walls during the dispensing operation. Alternatively, a soft foam may be placed in the package adjacent the edge walls.

The package-dispenser box can be formed from materials other than box board, and such materials include polymeric film, plastic, paper or the like.

Figure 3:
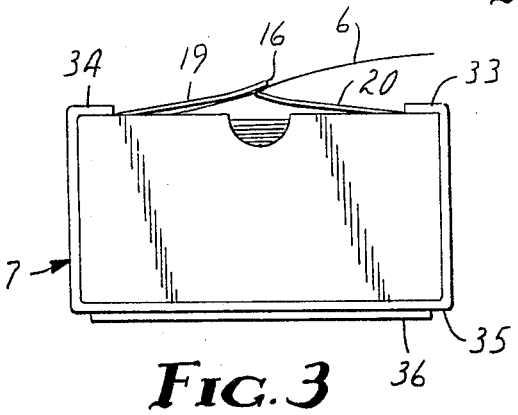
FIG. 3 is a fragmentary elevational view on an enlarged scale showing the sheet-retaining and gripping action afforded by the flaps of the package-dispenser of the present invention.

As illustrated in FIG. 3, the holder 7 surrounds three sides of the box and has flanges 33 and 34 extending over the edges of the upper wall 12 to retain the package-dispensers in the holder. The holder 7 is formed with a base 35 to which may be mounted suitable fastening means to permit the mounting of the holder 7 on a vertical surface, in an upside-down position, on the sun visor of an automobile, on the dash board of an automobile, on a telephone stand, etc. This mounting means 36 may be a sheet of double-coated pressure-sensitive adhesive tape, a sheet of magnetic material for mounting the holder on a metallic surface, a spring clip to fit over a shelf, visor or the like, one portion of a fastening tape such as a hook and loop fastening tape, permitting the holder to be securely mounted or readily removed as desired, or any number of other mounting means.

The dispenser is provided with the exit opening defined by an undulated cut in the material to form an undulated edge on the flaps, i.e. a saw-toothed edge, sine wave shaped, square wave shaped edge or the like, such that with a sheet disposed in the opening between the flaps, the projecting ends of the flap on one side tend to urge the sheet tightly against the extended ends of the other flap with sufficient force to prevent the sheet from falling back into the dispenser onto the stack of sheets. This edge with the extended portions defines sort of a labyrinth which also holds the next sheet as the sheets are peeled apart. The undulations on each edge extend past a center line across the cover by 0.05 to 0.25 inch and extend from each flap by 0.1 to 0.5 inch.

A specific example of the package-dispenser is a box enclosing a stack of 300 sheets of 20 pound bond paper 2.94 inches (7.46 cm) by 3.06 inches (7.78 cm). The box is formed of 24 point box board and has outside dimensions of $3.18 \times 3.125 \times 1.69$ inches ($8.096 \times 7.94 \times 4.29$ cm). The fixed edge of the flaps or the position of flexure of the flaps is spaced 0.375 inch (0.1 cm) from the edge of the box and have interference or undulations at the opening of 0.187 to 0.5 inch (4.76 to 12.7 mm). An example of the adhesive material is a pressure sensitive repositionable acrylate copolymer adhesive, as described in U.S. Pat. No. 3,691,140, assigned to the assignee of this application, coated on a strip adjacent the edge of each sheet 0.25 inch (6 mm) to 0.75 inch (19 mm) wide. The band of adhesive material would not exceed one-half the dimension of a sheet measured from the edge.

Suitable graphics and designs or logos may be printed on the package-dispenser 5 to make it attractive and to serve as an advertising medium.

While one embodiment of the invention is disclosed, it is to be understood that changes other than those mentioned may be made in details thereof without departing from the spirit or scope of the invention as claimed.

I claim:

1. A package of sheet material comprising a box-like structure for enclosing a stack of sheet material comprising a base, side walls joined together and interconnecting said base with a cover, said cover having a pair of slots with said slots extending along opposite marginal edges of the cover and a pair of flaps formed between the slots and defined by generally parallel side edges and opposed mating undulated free edges on each flap wherein the undulations on one of said free edges extend past the undulations of the other free edge between which the sheet material may be dispensed and said free edges affording interference with said sheets to hold a sheet between said edges, said marginal edges being spaced the width of a said stack of sheet material.

2. A package according to claim 1 wherein said undulated free edges of the flaps have a sine wave shape.

3. A package according to claim 2 wherein the undulations of said free edges extend from each flap by 0.1 to 0.5 inch or from a center line across the cover by 0.05 to 0.25 inch.

4. A package according to claim 1 wherein the undulations of said free edges extend past the free edges of the opposing flap by 0.1 to 0.5 inch.

5. A package according to claim 1 wherein said structure contains a stack of sheet material with said sheets releasably adhered to each other along opposite edges of successive sheets to permit the free edge of the top sheet to be positioned through and generally parallel to the free edges of said flaps.

6. A package according to claim 5 wherein means are provided on said side walls for supporting the sheets separated and raised from the stack.

7. A package according to claim 5 wherein said sheets are adhered by a band of pressure sensitive adhesive.

8. A package according to claim 7 wherein said band of adhesive is not greater than one-half the width of the sheet.

9. A package comprising a stack of sheet material comprising sheets of uniform size stacked one on top of another, said sheets being releasably adhered to each other by a band of pressure-sensitive adhesive positioned on each sheet along opposite edges of successive sheets, a box-like structure for enclosing a stack of sheet material comprising a base, side walls joined together and interconnecting said base with a cover, means in said cover for defining a pair of flaps having generally parallel side edges extending generally parallel along opposite marginal edges of said cover and each flap having an opposed mating undulated free edge extending between said side edges wherein the undulations on one of said free edges extend past the undulations of the other free edge between which the sheet material may be dispensed, said side edges having a length to form a slot along said marginal edges of said box-like structure and to permit the flaps to flex and cause said undulated edges to frictionally engage said sheets for holding a sheet between said undulated edges wherein a sheet dispensed between said edges will then be peeled from the next adjacent sheet and said flexible flaps and the free edges thereof will hold successive sheets from being dispensed under the forces applied to peel the sheets apart.

* * * * *